US006968586B2

(12) United States Patent
Havenor et al.

(10) Patent No.: US 6,968,586 B2
(45) Date of Patent: Nov. 29, 2005

(54) ELEVATION APPARATUS FOR AN INFANT

(76) Inventors: David J. Havenor, 10619 Whispering Pines, Frisco, TX (US) 75034; Amy C. Havenor, 10619 Whispering Pines, Frisco, TX (US) 75034

( * ) Notice: Subject to any disclaimer, the term of this patent is extended or adjusted under 35 U.S.C. 154(b) by 0 days.

(21) Appl. No.: 10/756,074

(22) Filed: Jan. 12, 2004

(65) Prior Publication Data

US 2005/0150052 A1 Jul. 14, 2005

(51) Int. Cl.[7] ..... A47D 13/08
(52) U.S. Cl. ..... 5/655; 5/633
(58) Field of Search ..... 5/655, 633, 731, 5/733, 630, 652

(56) References Cited

U.S. PATENT DOCUMENTS 4,471,767 A * 9/1984 Guimond ..... 601/5
4,566,449 A * 1/1986 Smith ..... 5/603
5,014,376 A * 5/1991 Doran et al. ..... 5/603
5,439,008 A * 8/1995 Bowman ..... 128/875
5,440,770 A * 8/1995 Nichols ..... 5/655
5,800,368 A * 9/1998 Klingemann et al. ..... 602/1
6,247,755 B1 * 6/2001 Canna et al. ..... 297/468

* cited by examiner

*Primary Examiner*—Michael Trettel
(74) *Attorney, Agent, or Firm*—Michael L. Diaz

(57) ABSTRACT

An apparatus for elevating a portion of the torso of an infant. The apparatus includes a main structure having a first planar surface and a second adjacent planar surface. The first planar surface is oriented at an angle of at least ten degrees from horizontal. The second planar surface is substantially horizontal. The apparatus also includes straps and a crotch support for retaining the infant against the main structure. The first planar surface includes a head indentation for placement of the infant's head within. The head indentation prevents the misshaping of the head, which the infant may be susceptible to from prolonged exposure to lying on his back.

10 Claims, 2 Drawing Sheets

ELEVATION APPARATUS FOR AN INFANT

BACKGROUND OF THE INVENTION

1. Technical Field of the Invention

This invention relates to infant devices, and more particularly, to an apparatus for elevating a surface for a recumbent infant.

2. Description of Related Art

There are quite a few infants who suffer from reflux disorders. One such common and very troublesome disorder is called gastroesophageal reflux. Gastroesophageal reflux is the inappropriate backwash of stomach contents into the esophagus. Common symptoms include pain, irritability, constant or sudden crying, frequent spitting-up, and vomiting. Obviously, these symptoms make for a very uncomfortable existence for the infant and the parents.

To combat these reflux disorders, many parents have resorted to elevating a portion of the infant's mattress to raise the infant's head above the rest of his body. By elevating the head, significant relief is observed with the infant. However, there are several problems associated with this configuration. First, it is quite common for the infant to slid downwardly from the top of the elevated mattress to its lower portion. With the baby portioned at the lowermost portion of the elevated mattress, any relief is eliminated. In addition, by positioning infant on a flat surface, such as a mattress, with the back of the infant's head in contact with the mattress, other problems may result. Plagiocephaly, or misshapen head, may result from continuous contact of the soft skull of the baby with the mattress. An apparatus is needed which elevates the head of the infant, comfortably prevents the baby from moving away from his desired elevated position, and does not cause plagio cephaly.

Thus, it would be a distinct advantage to have an apparatus to alleviate the symptoms of reflux disorders while comfortably holding an infant in a desired position. It is an object of the present invention to provide such an apparatus.

SUMMARY OF THE INVENTION

In one aspect, the present invention is an elevation apparatus for elevating a portion of an infant's body. The apparatus includes a main structure having a first planar surface and a second planar surface. The first planar surface is oriented at an angle of at least ten degrees from horizontal. The second planar surface is connected adjacent and below the planar surface. The second planar surface is substantially horizontal. The apparatus also includes a head indentation located on the first planar surface and straps attached to the first planar surface. A crotch support is connected to the main structure. The crotch support is attachable to the straps. An infant is positioned within the main structure with the head of the infant placed in the head indentation and the straps and crotch support retaining the infant upon the first and second planar surfaces, thereby elevating a portion of the infant's body.

In another aspect, the present invention is a method of elevating a portion of an infant's body. The method begins by utilizing an elevation apparatus for supporting the infant. The elevation apparatus includes two adjacent planar surfaces. The first planar surface is elevated upward to an angle of at least ten degrees. The infant is positioned on the elevation apparatus. The head of the infant is placed within an indentation located on the first planar surface. The upper torso of the infant is then positioned onto the first planar surface to elevate the upper torso of the infant. The infant is then retained within the elevation apparatus.

In still another aspect, the present invention is an elevation apparatus for elevating a portion of an infant's body. The apparatus includes a main structure having a first planar surface. The first planar surface is oriented at an angle of at least ten degrees from horizontal. The main structure also includes a second planar surface which is connected adjacent and below the first planar surface. The second planar surface being substantially horizontal. The apparatus also includes a head indentation located on the first planar surface and a hip indentation located on the main structure. A plurality of straps are attached to the first planar surface. A crotch support is connected to the main structure. In addition, the apparatus includes a retainer affixed to the main structure. A retainer is removably attached to the plurality of straps. An infant is positioned within the main structure with the head of the infant placed in the head indentation, the hips of the infant being placed in the hip indentation, and the straps and crotch support retaining the infant upon the first and second planar surfaces. Thus, a portion of the infant's body being elevated.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
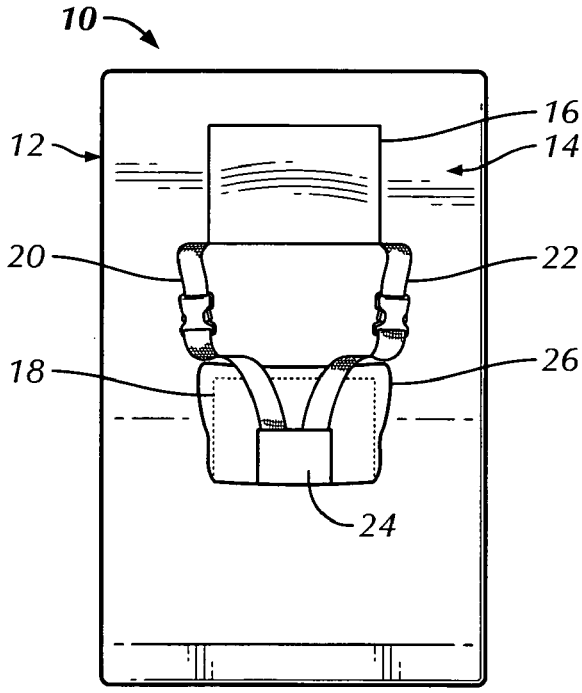
FIG. 1 is a top plan view of an elevation apparatus in the preferred embodiment of the present invention.

FIG. 1 is a top plan view of an elevation apparatus 10 in the preferred embodiment of the present invention. The elevation apparatus includes a main structure 12 having a substantially planar surface 14. Upon the planar surface 14 is a head indentation region 16, a hip indentation region 18 and two straps 20 and 22. The straps are affixed to a retainer 24. In addition, the elevation apparatus includes a crotch support 26.

Figure 2:
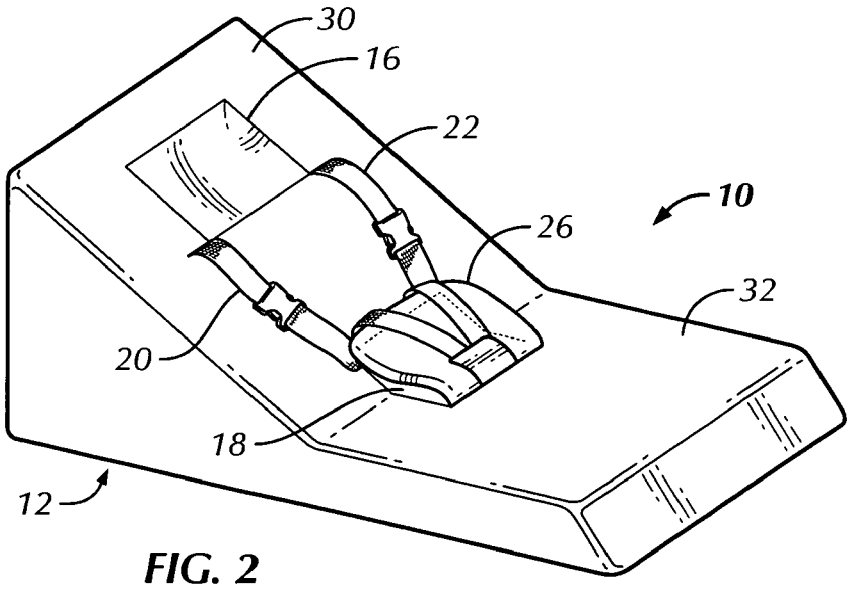
FIG. 2 is a side perspective view of the elevation apparatus of FIG. 1.

FIG. 2 is a side perspective view of the elevation apparatus 10 of FIG. 1. The planar surface 14 includes two distinct surfaces, each surface being at a different angle from its adjacent surface. An upper surface 30 is positioned at an angle ranging from approximately 20 to 30 degrees (preferably 30 degrees). A lower surface 32 is connected to the lower portion of the elevation apparatus. The lower surface is approximately horizontal.

Figure 3:
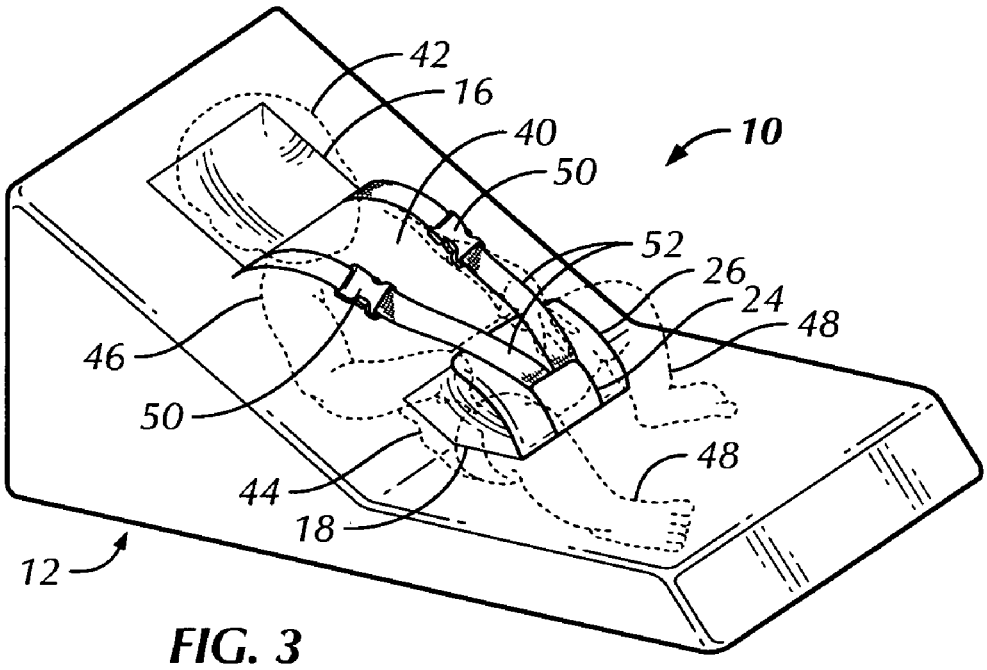
FIG. 3 is a side perspective view of the elevation apparatus with a baby positioned within the apparatus in the preferred embodiment of the present invention.

FIG. 3 is a side perspective view of the elevation apparatus with a baby 40 positioned within the apparatus in the preferred embodiment of the present invention. The baby is positioned within the elevation apparatus with the baby's head 42 located within the head indentation region 16. Preferably, the head indentation region includes a cushioned material to allow the baby to comfortably lay his head within the indentation. The head indentation region is depressed within the upper surface a sufficient amount so that the head of the baby does not move significantly, approximately one inch in depth. Both the upper and lower surfaces may be constructed of any material, although in the preferred embodiment, the material is soft to the touch and washable. In the preferred embodiment of the present invention, the elevation apparatus is a unitary body preferably composed of foam. However, an material may be used which provides a soft yet somewhat rigid structure.

The hips 44 of the baby 40 are positioned within the hip indentation region 18. The indentation region includes an indentation of approximately one inch to prevent undesirable movement of the baby. The straps are positioned over the shoulders 46 of the baby and attached by fasteners 50 to lower strap attachments 52. The lower strap attachments are attached to the retainer 24. The retainer is affixed to an outer surface at a lower end of the crotch support 26. The legs 48 of the baby are positioned underneath the crotch support. The crotch support holds the crotch area of the baby in position within the hip indentation region 18, thereby preventing the baby from moving into an undesirable position. The crotch support is preferably shaped like a diaper with the upper ends held in place against the main structure 12, preferably by snap-on buckles or fasteners.

Figure 4:
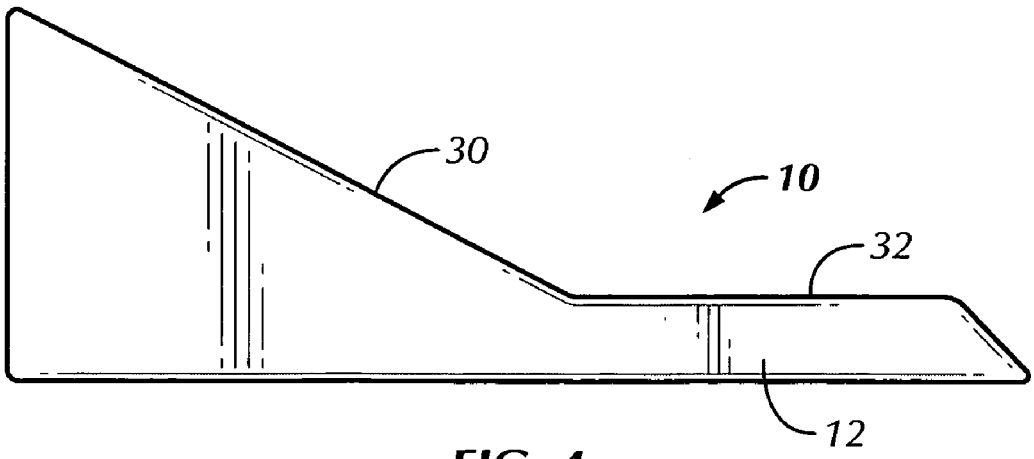
FIG. 4 is a side view of the elevation apparatus in the preferred embodiment of the present invention.

FIG. 4 is a side view of the elevation apparatus 10 in the preferred embodiment of the present invention. As illustrated in FIG. 4, the upper surface allows the baby's upper torso to be raised while allowing the baby's lower torso to remain parallel with the ground. A portion or the entire structure of the elevation apparatus may optionally be covered with a removable washable cloth.

With reference to FIGS. 1–4, the operation of the elevation apparatus will now be explained. The baby 40 is positioned upon the planar surface 14 by placing the hips 44 of the baby within the hip indentation region 18. In addition, the baby's head 42 is positioned within the head indentation region 16. The straps 20 and 22 are placed over each of the baby's shoulders 46 and connected by the fasteners 50 to the lower strap attachments 52. The baby's hips and legs are held under the crotch support 26 and retainer 24. In this position, the baby's upper torso is elevated, thereby preventing, to a large extend, any reflux action. With the hips located within the hip indentation region and the crotch support holding the hips of the baby, the baby is prevented from sliding down the inclined plane of the upper surface. Additionally, by utilizing a horizontally orientated lower surface, the chance of the baby sliding down is also reduced. In addition, because of the shape of the crotch support, the baby is held in a comfortable position without binding to the baby's pelvic area. The head indentation region allows the baby to lie on a flat surface without constant contact with a flat horizontal surface, which may cause an infant's head to become misshapen.

In alternate embodiments of the present invention, the elevation apparatus may be constructed of a rigid frame covered with a soft material. In addition, the straps may be configured in any fashion which holds the baby in place upon the inclined upper surface 30.

The present invention provides many advantages over existing devices. First, the elevation apparatus 10 enables a baby to be comfortably held in an elevated inclination. The baby is prevented from sliding down the inclined upper surface 30 by the hip indentation region 18, the crotch support 26 and the retainer 24. Additionally, by utilizing two angles on the planar surface, the baby is further prevented from sliding downward. The elevation apparatus also reduces the likelihood of a misshapen head.

It is thus believed that the operation and construction of the present invention will be apparent from the foregoing description. While the apparatus shown and described has been characterized as being preferred, it will be readily apparent that various changes and modifications could be made therein without departing from the scope of the invention as defined in the following claims.

What is claimed is:

1. An elevation apparatus for elevating a portion of an infant's body, said apparatus comprising:

a unitary main structure having a top side comprising:

a first planar surface, said first planar surface being orientated at an angle of at least ten degrees from horizontal; and a second planar surface, said second planar surface adjacent to said first planar surface, said second planar surface being substantially horizontal;

the first planar surface and the second planar surface forming the top side of the unitary main structure:

a head indentation located on said first planar surface;

a plurality of straps attached to said first planar surface;

a crotch support connected to said main structure, said crotch support being attachable to said plurality of straps;

whereby an infant is positioned upon the top side of the main structure with the head of the infant placed in the head indentation and the plurality of straps and crotch support retaining the infant upon said first and second planar surfaces, a portion of the infant's body being elevated.

2. The elevation apparatus for elevating a portion of an infant's body of claim 1 wherein a portion of said main structure is covered with a removable washable cloth.

3. The elevation apparatus for elevating a portion of an infant's body of claim 1 wherein said crotch support includes fasteners for connecting to said plurality of straps.

4. The elevation apparatus for elevating a portion of an infant's body of claim 1 further comprising a retainer affixed to said main structure, said retainer having fasteners providing removable attachment to said plurality of straps.

5. The elevation apparatus for elevating a portion of an infant's body of claim 1 further comprising a hip indentation, whereby the infant is positioned within the hip indentation to prevent undesirable movement of the infant.

6. The elevation apparatus for elevating a portion of an infant's body of claim 1 wherein the first planar support is elevated to an angle between ten degrees and forty degrees from a horizontal orientation.

7. A method of elevating a portion of an infant's body, the method comprising the steps of:

providing an elevation apparatus, the elevation apparatus having a top surface comprising a first planar surface and an adjacent second planar surface, the first planar surface being elevated upwardly to an angle of at least ten degrees, the first planar surface and second planar surface forming a unit body of the elevation apparatus;

positioning an infant on the top surface of the elevation apparatus;

placing the head of the infant within an indentation located on the first planar surface;

positioning the upper torso of the infant onto the first planar surface to elevate the upper torso of the infant; and retaining the infant within the elevation apparatus.

8. The method of elevating a portion of an infant's body of claim 7 wherein the step of retaining the baby includes strapping the infant's body to the elevation apparatus.

9. The method of elevating a portion of an infant's body of claim 7 wherein the elevation apparatus includes a crotch support attached to the elevation apparatus, the crotch support retaining the pelvic area of the infant against the elevation apparatus.

10. An elevation apparatus for elevating a portion of an infant's body, said apparatus comprising:

a main structure having:

a first planar surface, said first planar surface being orientated at an angle of at least ten degrees from horizontal; and a second planar surface, said second planar surface position connected adjacent and below said first planar surface, said second planar surface being substantially planar;

a head indentation located on said first planar surface;

a hip indentation located on said main structure;

a plurality of straps attached to said first planar surface;

a crotch support connected to said main structure;

a retainer affixed to said main structure, said retainer removably attached to the plurality of straps;

whereby an infant is positioned within the main structure with the head of the infant placed in the head indentation, the hips of the infant being placed in the hip indentation, and the plurality of straps and crotch support retaining the infant upon said first and second planar surfaces, a portion of the infant's body being elevated.

* * * * *